United States Patent [19]

Johansen

[11] Patent Number: 4,844,697

[45] Date of Patent: Jul. 4, 1989

[54] IMPELLER FOR AN AXIAL FLOW FAN

[75] Inventor: Ulrik Johansen, Vejle, Denmark

[73] Assignee: Novenco A/S, Naestved, Denmark

[21] Appl. No.: 179,784

[22] Filed: Apr. 11, 1988

[30] Foreign Application Priority Data

Apr. 10, 1987 [DK] Denmark ..... 1870/87

[51] Int. Cl.[4] ..... F04D 29/36

[52] U.S. Cl. ..... 416/157 R; 416/147; 416/168 R; 416/205; 416/209

[58] Field of Search ..... 416/147, 205, 157 C, 416/245 B, 157 R, 168 R, 209, 159, 239; 415/129, 130

[56] References Cited

U.S. PATENT DOCUMENTS

| | | | |
|---|---|---|---|
| 1,908,894 | 5/1933 | Findley | 416/147 X |
| 1,927,592 | 9/1933 | Lambert | 416/141 R |
| 2,023,785 | 12/1935 | Hoover . | |
| 2,080,540 | 5/1937 | Isaac | 416/205 |
| 2,460,910 | 2/1949 | Sheets et al. . | |
| 2,473,899 | 6/1949 | Murphy | 416/159 X |
| 2,664,961 | 1/1954 | Goedo . | |
| 2,793,702 | 5/1957 | Cushman | 416/245 R |
| 2,801,793 | 8/1957 | Kline | 416/245 R X |
| 4,281,966 | 8/1981 | Duret et al. | 416/168 R X |
| 4,619,586 | 10/1986 | Carter | 416/167 X |

FOREIGN PATENT DOCUMENTS

| | | | |
|---|---|---|---|
| 526062 | 2/1954 | Belgium | 416/157 R |
| 1008184 | 5/1952 | France | 416/205 |
| 88498 | 5/1983 | Japan | 415/130 |
| 987196 | 1/1983 | U.S.S.R. | 416/239 |
| 598991 | 3/1948 | United Kingdom | 416/147 |
| 1011419 | 12/1965 | United Kingdom | 416/205 |
| 1372962 | 11/1974 | United Kingdom | 416/157 C |

*Primary Examiner*—Everette A. Powell, Jr.
*Attorney, Agent, or Firm*—Sughrue, Mion, Zinn, Macpeak & Seas

[57] ABSTRACT

In an impeller for use in an axial flow fan and having blades (5) which are adjustable during operation of the fan, each blade (5) is, through a blade shaft (7) connected to a hub (1) designed as a compact unit.

The blade shaft (7) and an axial thrust bearing device (9) on which the blade (5) is journalled in such a manner that it can, through a control mechanism, be pivoted about its axis for controlling the blade angle, are retained axially in a bearing housing (8) screwed into a threaded bore (18) in the periphery of the hub (1).

For adjusting the radial distance between the periphery of the hub (1) and the blade tip the thrust bearing device (9) is held against a closed end of the bearing housing (8) by a spring (43) and a nut (14) screwed onto a threaded portion (15) of the blade shaft (7) and lockable in an arbitrary position by a lock screw (16).

6 Claims, 4 Drawing Sheets

IMPELLER FOR AN AXIAL FLOW FAN

Figure 1:
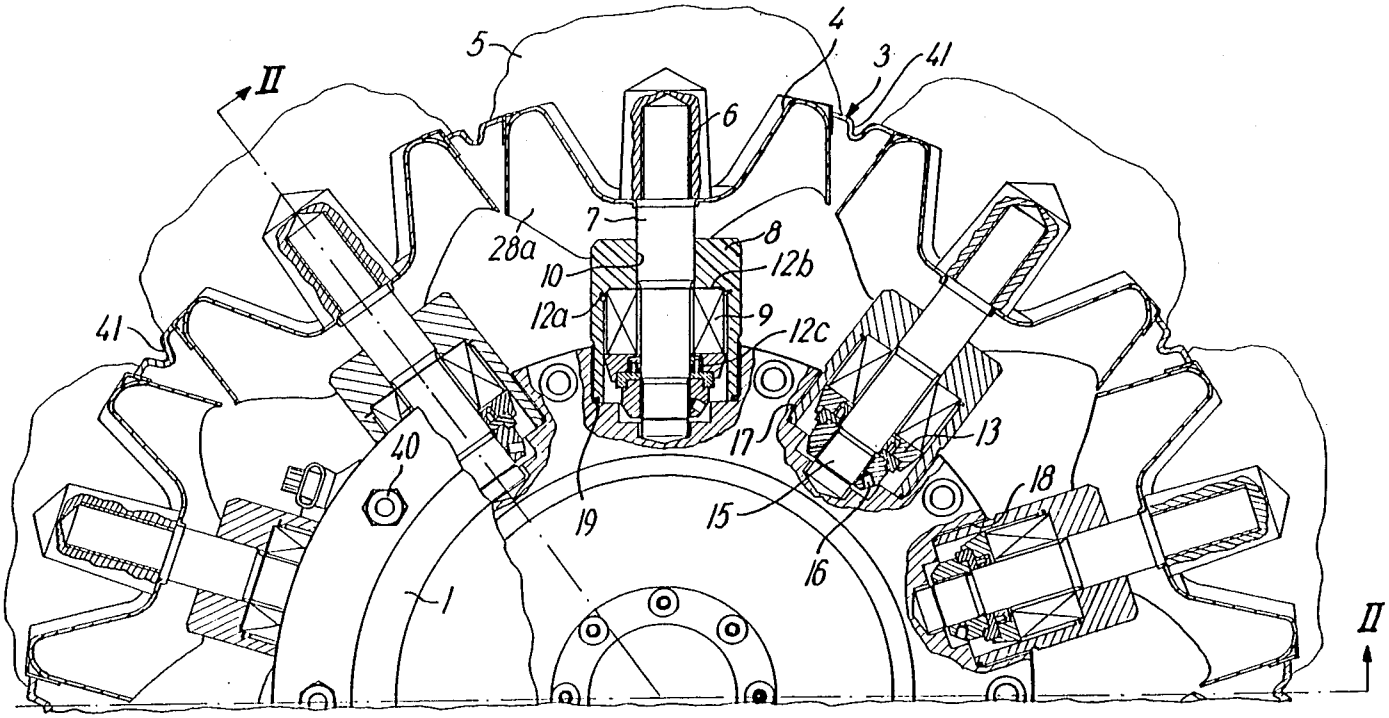

This invention relates to an axial flow fan impeller having a plurality of blades which are adjustable during operation of the fan, each blade being journalled, by a separate axial thrust bearing device, in the impeller in such a way that a control mechanism built into the impeller may pivot the blades about their axes for controlling the blade angle, each blade being associated with a blade shaft coaxial with the blade axis and connecting the blade to a hub formed as a compact unit.

From accepted Danish specification No. 134 196 there is known an axial flow fan impeller of the kind referred to, in which the thrust bearing device of each blade is accommodated in a bearing housing formed directly in the blade root and the blade is journalled on a blade shaft secured in the hub. With this design it it possible, by combining one single hub size of compact and standardized type with blade shafts of different lengths and an outer impeller cover of correspondingly adapted size, to manufacture fans for different output ranges.

In this known embodiment the incorporation of the bearing housing in the blade root proper, which is motivated by the desire of permitting the use of blades of one size and shape for different operational ranges, results in a more complicated blade production. Furthermore, the mass concentration otherwise obtainable with a compact hub unit, and which is advantageous in respect of the load conditions, is to some extent counteracted by the location of the bearing housing and the thrust bearing device as far out as at the blade root.

From U.S. Pat. No. 2,023,785 there is known a variable pitch propeller in which each propeller blade, through associated radial bearings, is journalled in a bearing housing which at its end oriented toward the blade is closed by a flange extending inwardly towards the blade shaft and constituting an abutment for the radial bearings within the bearing housing, and by a seal mounted in the flange. At its opposite end the housing has an external thread engaging with a mating thread in the propeller hub. The blade is retained in the axial direction relative to the bearing housing which has been screwn into the hub until a shoulder abuts on the outer surface thereof.

An impeller according to the present invention retains, to a substantial extend, the advantages of standardization associated with the known impeller referred to above, while the individual component parts of the impeller are of rather simple design, and the clearance between each blade tip and the surrounding fan casing or air duct may be adjusted in a simple way. Furthermore, there is obtained an advantageous concentration of the impeller mass, whereby the loads on the hub resulting from centrifugal forces are reduced and occur substantially as radial forces without bending moments. Consequently the construction is subjected substantially to tension only which results in essential advantages for the dimensioning.

According to the invention an axial flow fan impeller of the kind initially referred to is characterized in that the blade shaft and the axial thrust bearing device of each blade are retained in the axial direction within a bearing housing which, at its end oriented towards the blade, is closed and formed with a through bore for receiving the blade shaft and which, at its opposite end, is provided with connecting means for direct engagement with conjugated connecting means in or at the outer periphery of the hub, and in that there is provided locating means permitting axial displacement of the thrust bearing device along part of the blade shaft for adjusting the radial distance from the periphery of the hub to the blade tip.

Because the blade is axially retained in the bearing housing, the blade shaft with the associated bearing housing and thrust bearing device can be designed as a prefabricated subunit which can readily be mounted in the hub, and the combined axial length of the blade, blade shaft and bearing housing is adjustable, which causes a substantial reduction of the requirements to the tolerances of the impeller components.

This adjustability which not only is of essential importance for the efficiency of an axial flow fan, but which is also important in connection with an exchange of the thrust bearing device, e.g. due to wear, implies that the subunit consisting of the blade shaft and the baring housing with associated thrust bearing device can be adjusted exactly to the desired radial length before being mounted in the impeller, so that after assembly the clearance between the blade tip and the casing surrounding the impeller is optimized.

In addition, the invention permits the use of oil-lubricated thrust bearing devices, as known in principle from inter alia Danish patent specification No. 140 570. With this in mind an embodiment of the impeller according to the invention is characterized in that each bearing housing is provided with a sealing device comprising a piece of tube located within the bearing housing coaxially with the blade shaft, said piece of tube having a sealing means at its end oriented towards the hub and being sealed against the closed end of the housing at its other end. The sealing device at the protruding blade shaft causes the lubricating oil to remain in the bearing housing notwithstanding the larger centrifugal force resulting from the rotation of the impeller.

The provision of a rubber-elastic sealing ring at the bottom of each threaded bore in the hub opposite the terminal edge of the bearing housing has the advantage that the lubricating oil can be introduced into the threaded bore in the hub prior to the mounting of the blade. When subsequently the subunit comprising the blade shaft and the bearing housing has been mounted the oil will be thrown out into the bearing housing in response to the rotation of the impeller.

Also in impellers of large diameters the adjustment possibility resulting from the invention may lead to an advantageous mass concentration which can be further enhances by forming the peripheral wall of the impeller as a circumferential, rather thin-walled shell connected to the hub and having apertures for receiving a blade root of each blade and integral reinforcing means intermediate said apertures.

A further improvement of the advantageous mass concentration in connection with the compact hub unit is obtained in an embodiment of the invention which is characterized in that each blade is associated with a cup-shaped control arm comprising a cup-shaped end wall serving for motion-transmitting engagement with the blade and having a frusto-conical portion with elongate apertures for engaging lugs on the blade root and a central hole for receiving the blade shaft, a web secured to the end wall coaxial therewith and formed with bearing means connected to the linkage of the control mechanism, and at least two evenly distributed weight holders secured to the outside of the web, said end wall, said web, and said weight holders being made of pressed thin sheet metal.

Figure 2:
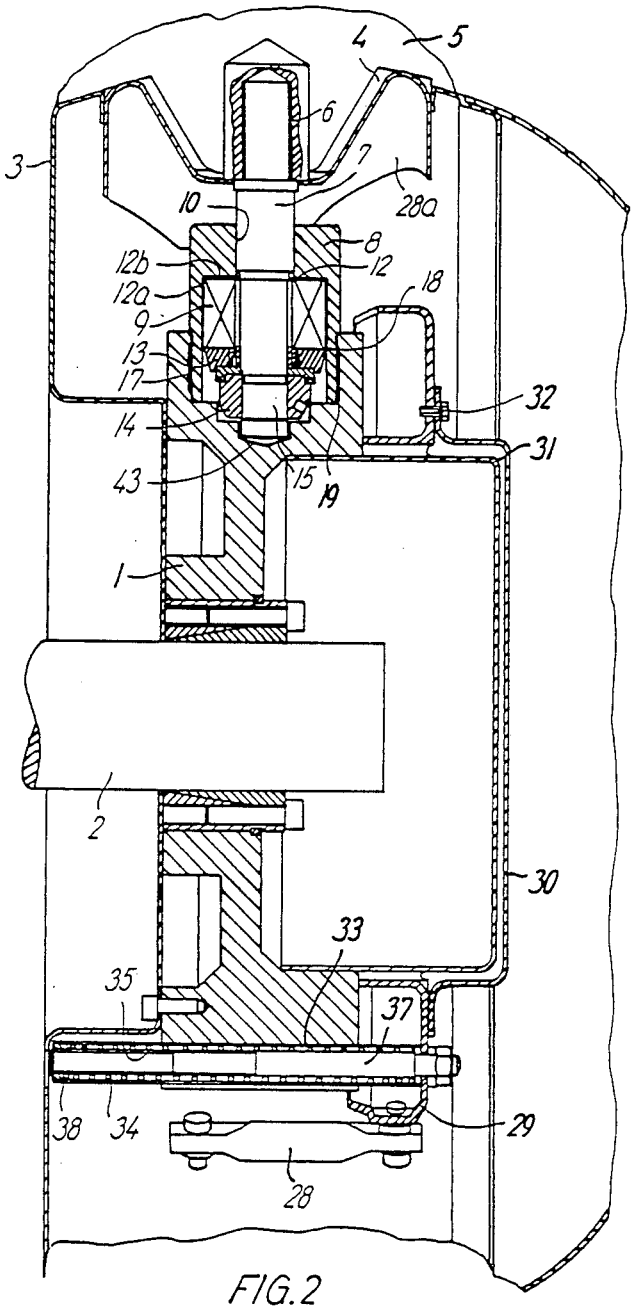
Figure 3:
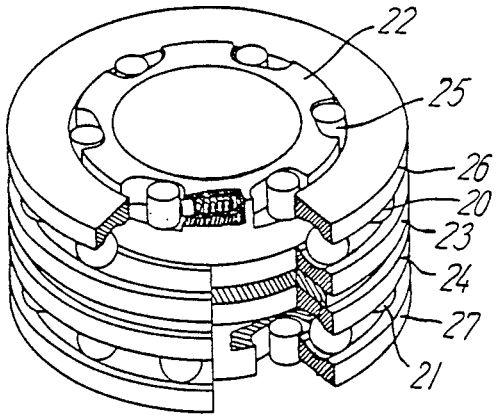
Figure 4:
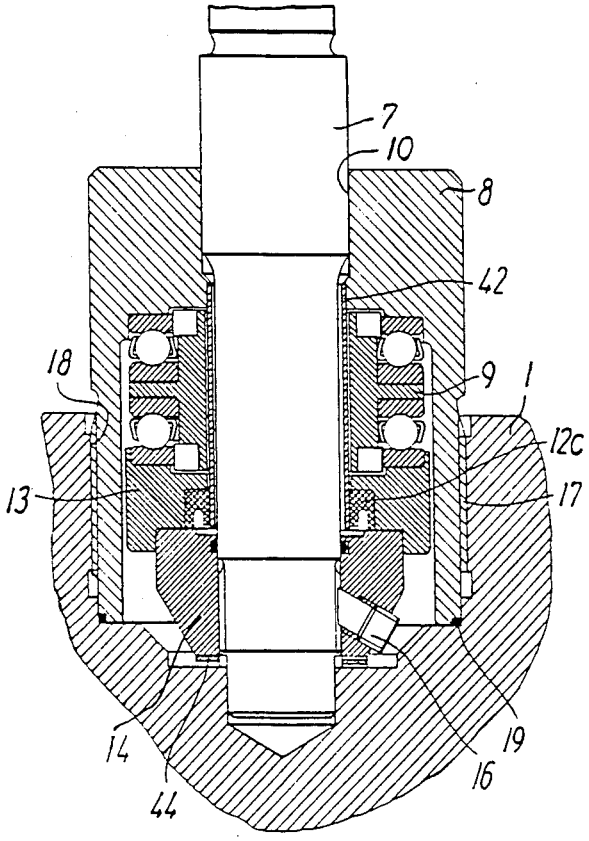
Figure 5:
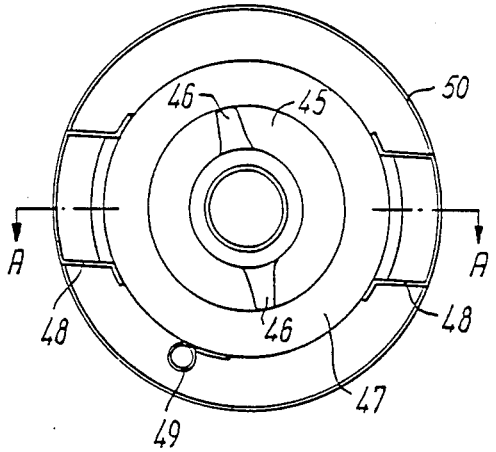
Figure 6:
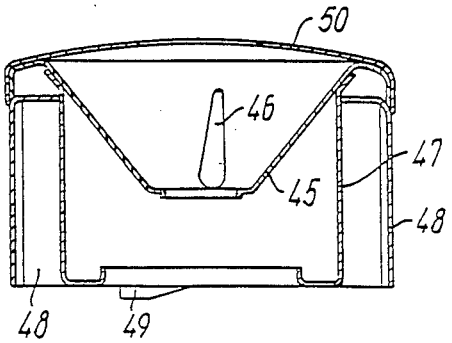

The invention will now be described in more detail by way of embodiments and with reference to the accompanying drawings, in which FIG. 1 is a fractional view, in radial section, of an impeller embodying the invention, FIG. 2 is a section along line II—II of FIG. 1, FIG. 3 is a perspective view of a thrust bearing device, FIG. 4 is a cross-section through a modified bearing housing in an impeller embodying the invention, FIG. 5 is a plan view of a control arm as seen from the hub of the impeller, and FIG. 6 is a section along line A—A of FIG. 5.

In the embodiment illustrated in FIGS. 1–3 the impeller according to the invention comprises a hub 1 formed as a compact unit for being secured directly to a motor spindle 2.

The impeller is outwardly defined by a shell 3 which may be made of pressed thin metal sheet. Shell 3 has apertures 4 for a plurality of blades 5 which are journalled such that during rotation of the impeller they can, by a control mechanism, be pivoted on their axes for controlling the blade angle.

Thus, each blade 5 is formed with an internal thread 6 in the blade root whereby the blade is screwed onto the outer end of a blade shaft 7, the opposite end of which is retained in the axial direction of the blade and the blade shaft within a bearing housing 8. An axial thrust bearing device 9 received in housing 8 permits the above mentioned pivoting of blade 5.

The outer end of bearing housing 8 facing blade 5 is closed and formed with a through bore 10 for receiving blade shaft 7. In order to avoid that a lubricant for bearing device 9 is thrown out of housing 8 in response to the strong centrifugal force created by the rotation of the impeller, blade shaft 7 may be surrounded by a sealing device 12 comprising a piece of tube inserted between bearing device 9 and blade shaft 7 and having, at its ende oriented towards the blade, a flange 12*b* sealed against the bearing housing by a gasket 12*a* and formed with a downturned outer rim. The end of the piece of tube oriented towards the hub is sealed against a nut 14 by a gasket 12*c*.

In FIG. 4 there is shown a different bearing housing in which the sealing device includes a piece of tube 42 which in a similar manner as described above is sealed against nut 14, but wherein the seal against the blade has been obtained by arranging tube 42 in the inner part of bore 10 in the housing 8 and gluing the tube to the wall of the bore. It has been found that in this way there can be obtained a sealing sufficiently effective for permitting oil lubrication of bearing device 9.

On its side oriented towards hub 1 bearing device 9 is held against the bottom of bearing housing 8 by a compression spring 43 located in a bore in the hub and operative on the end face of blade shaft 7, and by a washer 13 and adjustment device in the form of nut 14 which has been screwed onto a threaded portion 15 of the innermost part of blade shaft 7 and which can be clamped to the blade shaft in an arbitrary position along thread 15 by means of a lock screw 16. In the embodiment of FIG. 4 spring 43 has been replaced by a compression spring 44 which acts on nut 14.

Blade shaft 7 and bearing housing 8 including the thrust bearing device 9 retained in the housing have been built together as a subunit serving for connecting blade 5 to hub 1. For this purpose the innermost, open end of the cylindric bearing housing 8 is formed with an external thread 17 capable of being screwed into a threaded bore 18 in the periphery of hub unit 1.

The location of bearing device 9, by nut 14 and spring 43 or 44, within bearing housing 8 permits to shift the bearing housing axially along blade shaft 7 and thus to adjust the axial length of the subunit consisting of blade shaft 7 and bearing housing 8, as counted from the open end of bearing housing 8, which is screwed into the threaded bore 18, to the opposite end of blade shaft 7, which is screwed into the threaded bore 6 in the blade root.

In this way there is obtained in extremely advantageous possibility of adjusting the total radial distance from the center line of hub unit 1 to the outermost tip (not shown) of blade 5 and thus of adjusting the clearance between the blade tip and a surrounding fan casing to an optimum value which ensures a high efficiency without risk of damaging the blade.

This adjustment possibility also implies that in the manufacture of the blade, the blade shaft, and the bearing housing the tolerance requirements can be less severe which cooperates with the simple design of the hub unit, the bearing housing, the blade shaft, and the blade proper to reduce the manufacturing costs.

The provision of blade shaft 7 and bearing housing 8 including bearing device 9 as a pre-assembled subunit which at the final assembly may be adjusted to the desired axial length results, additionally, in a simpler and cheaper assembly operation, during which a suitable amount of lubricating oil for thrust bearing device 9 may be introduced into threaded bore 18 immediately before bearing housing 8 is screwed into the bore. The provision of a rubber-elastic sealing ring 19 at the bottom of bore 18 safeguards against leakage of the lubricating oil which during the rotation of the impeller is thrown out into bearing device 9.

Preferably, as shown in FIG. 3, thrust bearing device 9 comprises two coaxially arranged thrust bearings 20 and 21 which are series-connected with respect to their load, and a retaining member 22 located inwardly of the bearing tracks of both bearings and rigidly connected to the two bearing tracks or races 23 and 24 located next to one another. Clamping bodies 25 arranged between retaining member 22 and the bearing races 26 and 27 carrying the two other, remotely located, tracks of bearings 20 and 21, permit either race 26 or 27 to be locked against rotation in one or the other direction of rotation, respectively.

With this bearing device which is disclosed in applicant's Danish patent application No. 6233/86 it has, in practice, been found possible to avoid the deterioration of the bearing tracks which in conventional blade suspension bearings of axial flow fans are caused by the fact that due to hunting in the control mechanism the blade constantly carries out small and disturbing swiveling movements. Thus there is obtained a highly wear-resistant bearing device with considerably longer lifetime than conventional bearings.

With the bearing means shown in FIG. 3 there is obtained a small bearing diameter and, despite the use of the two thrust bearing 20 and 21 axially behind one another, a relatively short axial construction length which is advantageous for mounting the bearing means in housing 8.

In combination with the compact hub unit 1 the design of the bearing device with bearing housing 8 screwed directly into the periphery of the hub ensures an advantageous mass distribution whereby the centrifugal forces occurring during rotation of the impeller produce substantially radial tension forces only, but no bending moments in the hub structure. Since furthermore the hub structure can be made short in the direction of the impeller axis the impeller may be secured directly to the motor spindle of a drive motor without involving any dangerous load conditions.

For contributing the load-advantageous mass distribution obtained by the compact hub structure the outer wall of the impeller is preferably, as mentioned above, formed by a shell 3 made from thin, pressed sheet metal. For reinforcing the shell 3 there may, between the apertures 4 for receiving the blades 5, be provided depressed reinforcing ribs 41 extending substantially in the direction of the impeller axis.

A further mass reduction at the periphery of the impeller results from the design of the control arm, as shown in FIGS. 5 and 6, for pivoting blade 5 in response to a movement of a link 28. An end wall 45 made of thin sheet metal is formed with apertures 46 designed so as to receive lugs on the blade root in motiontransmitting engagement. To the face of end wall 45 oriented towards the hub there has been spot-welded a web 47 of thin sheet metal and to the outside of web there has, also be spot-welding, been secured two diametrically opposed weight holders 48 and a protuberance 49 forming a pivot bearing for line 28. When link 28 is displaced in the axial direction of the impeller, the axial force exerted on protuberance 49 will cause the control arm including end wall 45 to rotate through an angle corresponding to the axial displacement. Because the apertures 46 in the end wall 45 engage the blade rood, blade 5 will rotate through an equal angle. The blade is balanced by weights, such as small pieces of lead, secured to the weight holders 48 such as by riveting through aligned holes in each weight and the holder. This balancing is possible because blade 5 and the control arm including end wall 45, web 47, weight holders 48, and protuberance 49 is moving as a unit with blade 5 due to the engagement between blade 5 and apertures 46 in the end wall. For equalizing the centrifugal moment of blades 5 of different length the amount of lead and the angular position of each weight relative to the blade may be varied within holder 48. A cover 50 is arranged over the frusto-conical depression in end wall 45.

As a consequence of the design described above including a very compact hub structure and the blade shafts and hearing housings combined into ready-to-mount subunits the impeller according to the invention is extremely well suited to the manufacture of axial flow fans for different operational ranges, where the production of fans for each operational range occurs in smaller series. For a considerably varying range of impeller diameters it is possible to employ one hub structure only and one type only of the bearing housing and the thrust bearing device mounted therein for being assembled with blade shafts of different length.

I claim:

1. An axial flow fan impeller having a plurality of blades which are adjustable during operation, each blade having a blade axis and a blade tip, the impeller comprising:

a blade shaft (7) associated with each blade, the shaft being coaxial with the blade axis, an axial thrust bearing (9) and a bearing housing (8) provided for each blade, a hub formed as a compact unit and having an outer periphery, the blade shaft connecting the blade to the hub, a control mechanism having separate thrust bearing devices journalling each blade in the impeller whereby that the control mechanism may pivot the blades about their axis for controlling the blade angle, a bearing housing with a first end oriented towards the blade (5) and is second end opposite the first end, connecting means (17) provided at the second end of the bearing housing, a conjugated connecting means (18) near the outer periphery of the hub (1) for direct engagement with the connecting means (17) at the second end, a through bore at the first end of the housing for receiving the blade shaft (7), the blade shaft and the axial thrust bearing (9) of each blade being retained in the axial direction within the bearing housing (8) which is thereby closed at its first end, and locating means (13,14) permitting axial displacement of the thrust bearing (9) along a portion (15) of the blade shaft (1) for adjusting the radial distance from the periphery of the hub to the blade tip.

2. An impeller as claimed in claim 1, wherein the connecting means at the second end of the bearing housing (8) comprises an external thread (17), and the conjugated connecting means comprises a threaded bore (18) in the periphery of the hub (1).

3. An impeller as claimed in claim 1, wherein the blade shaft has a threaded portion, said locating means comprising a nut (14) screwed into the threaded portion (15), and retaining means (16) associated with the nut for retaining the nut (14) on said shaft portion.

4. An impeller as claimed in claim 1, further comprising a tube located within each bearing housing coaxially with the blade shaft and having a first end oriented towards the hub and a second end sealingly engaged with the through bore in the housing, and a sealing means provided at the first end of the tube.

5. An impeller as claimed in claim 4, wherein the connecting means (17) at the second end of the bearing housing (8) having a terminal edge is an external thread (17), the conjugated connecting means is a threaded bore (18) in the periphery of the hub (1), and an elastic sealing ring (19) is provided at the bottom of each threaded bore and opposite the terminal edge.

6. An impeller as claimed in claim 1, wherein each blade has a blade root with lugs, said control mechanism having a linkage, comprising a cup-shaped control arm associated with each blade (5), said control arm including, a cup-shaped end wall (45) for motion-transmitting engagement with the blade, a frusto-conical portion in the end wall, elongate apertures (46) in the frusto-conical portion for engaging the lugs on the blade root, a central hole in the frusto-conical portion for receiving the blade shaft, a web (47) secured to the end wall coaxial therewith, bearing means (49) formed on thew web for connecting the end wall with the linkage of the control mechanism, and at least two evenly distributed weight holders (48) secured to the outside of the web, the end wall (45), the web (47) and the weight holders (48) being made of pressed thin sheet metal.

* * * * *